US007275817B2

(12) United States Patent
Clark et al.

(10) Patent No.: US 7,275,817 B2
(45) Date of Patent: Oct. 2, 2007

(54) FORMATION OF NOVEL INK JET FILTER PRINTHEAD USING TRANSFERABLE PHOTOPATTERNED FILTER LAYER

(75) Inventors: Shan Clark, Forest Grove, OR (US); Gary Kneezel, Webster, NY (US); Ram Narang, Macedon, NY (US); Bidan Zhang, Lagrandeville, NY (US); Almon Fisher, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 42 days.

(21) Appl. No.: 11/134,662

(22) Filed: May 20, 2005

(65) Prior Publication Data

US 2005/0214673 A1 Sep. 29, 2005

Related U.S. Application Data

(62) Division of application No. 10/442,569, filed on May 21, 2003, now Pat. No. 7,101,030.

(51) Int. Cl.
*B41J 2/175* (2006.01)

(52) U.S. Cl. ..... 347/93; 347/84

(58) Field of Classification Search ..... 347/93, 347/1, 84; 210/348; 430/229, 269, 311, 430/312, 319, 320; 156/235, 239, 240, 241, 156/247, 289

See application file for complete search history.

(56) References Cited

U.S. PATENT DOCUMENTS

| | | | |
|---|---|---|---|
| 4,251,824 | A | 2/1981 | Hara et al. |
| 4,380,770 | A | 4/1983 | Maruyama |
| 4,571,599 | A | 2/1986 | Rezanka |
| 4,639,748 | A | 1/1987 | Drake et al. |
| 4,673,955 | A | 6/1987 | Ameyama et al. |
| 4,864,329 | A | 9/1989 | Kneezel et al. |
| 5,124,717 | A | 6/1992 | Campanelli et al. |
| 6,139,674 | A | 10/2000 | Markham et al. |
| 6,234,623 | B1 | 5/2001 | Drake |
| 6,779,877 | B2 | 8/2004 | Andrews |

*Primary Examiner*—Manish S. Shah
(74) *Attorney, Agent, or Firm*—Perman & Green, LLP; Christopher D. Wait

(57) ABSTRACT

Disclosed is a process for forming a channel wafer for a novel ink jet printhead, having an ink particle-filter layer over the ink-inlet surface thereof. The process includes the steps of applying a thin coating of a heat-curable, photopatternable polymer composition to an intermediate substrate having a release surface and drying the coating to form a semi-solid adhesive layer. The layer and supporting substrate are pressed against the ink-inlet surface of a channel wafer with an optional adhesive layer to bond the layer to the ink inlet surface. The substrate is separated to transfer the contacting area of the semi-solid layer to the ink-inlet surface as a laminate, and the semi-solid layer is exposed through a filter-forming mask and ink particle-filter openings are developed therethrough, either before or after transfer of the semi-solid adhesive layer from the intermediate substrate to the ink-inlet surface of the channel wafer, and the filter layer is cured.

4 Claims, 3 Drawing Sheets

Figure 1:
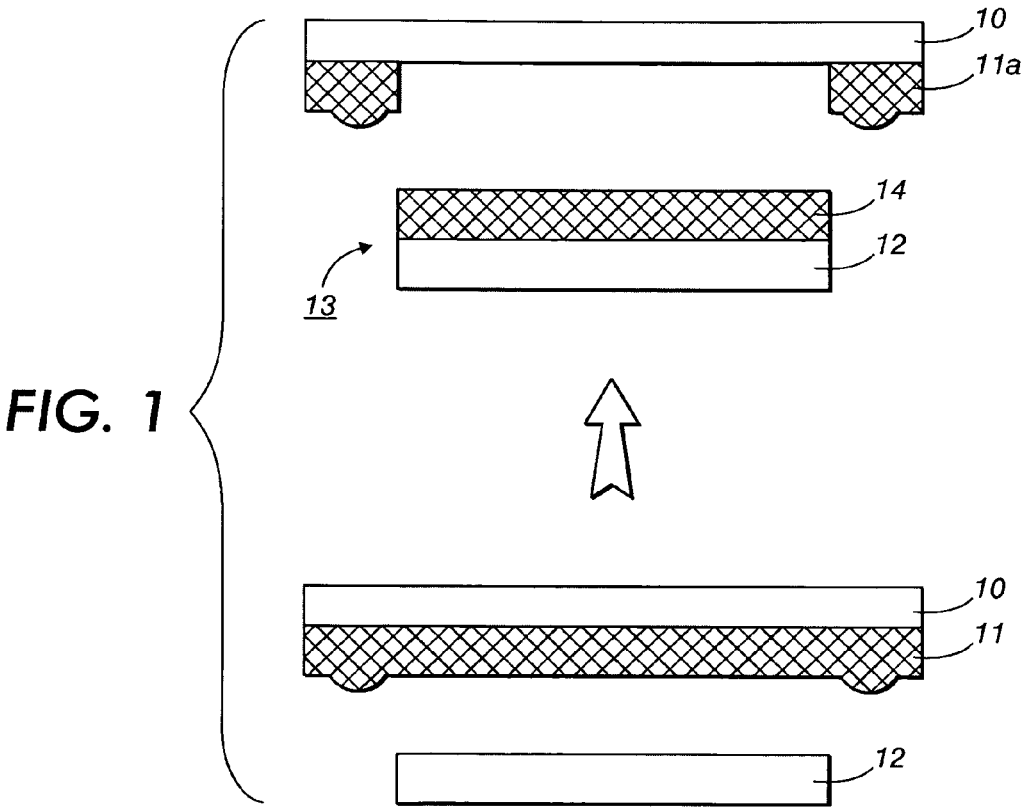

FORMATION OF NOVEL INK JET FILTER PRINTHEAD USING TRANSFERABLE PHOTOPATTERNED FILTER LAYER

CROSS-REFERENCE TO RELATED APPLICATIONS

This is a divisional of U.S. application Ser. No. 10/442,569 filed May 21, 2003 now U.S. Pat. No. 7,101,030 by the same inventors, and claims priority therefrom. This divisional application is being filed in response to a restriction requirement in that prior application and contains re-written and/or additional claims to the restricted subject matter.

BACKGROUND OF THE INVENTION

1. Field of the Invention

This invention relates to an ink jet printhead or other microfluidic device having a substantially flat laminated filter and process for fabricating the printhead with such filter.

2. Brief Description of the Prior Art

There are many well known, relatively small fluid handling devices which contain a filter for preventing contaminates entrained in a fluid from entering the device. Generally, the filters are individually assembled in or attached to each separate device during manufacture. A typical example of a small fluid handling device is a thermal ink jet printhead.

A typical thermally actuated drop-on-demand ink jet printing system uses thermal energy pulses to produce vapor bubbles in an ink filled channel that expels drop-lets from the channel orifices of the printing systems printhead. Such printheads have one or more ink filled channels communicating at one end with a relatively small ink supply chamber and having an orifice at the opposite end, also referred to as a nozzle. A thermal energy generator, usually a resistor, is located in the channels near the nozzle and at a predetermined distance upstream therefrom. The resistors are individually addressed with a current pulse to momentarily vaporize the ink and form a bubble which expels an ink droplet. A meniscus is formed at each nozzle under a slight negative pressure to prevent ink from weeping therefrom.

U.S. Pat. No. 4,639,748 to Drake et al. discloses a thermal ink jet printhead composed of two parts aligned and bonded together. One part is a substantially flat substrate which contains on the surface thereof a linear array of heating elements and addressing electrodes. The other part is a flat substrate having a set of concurrently etched recesses in one surface. The set of recesses include a parallel array of elongated recesses for use as capillary filled ink channels having ink droplet emitting nozzles at one end and having interconnection with a common ink supplying manifold recess at the other ends. The manifold recess contains an integral closed wall defining a chamber within the manifold recess and ink fill hole. Small passageways are formed in the top edge of the internal chamber walls to permit passage of ink therefrom into the manifold. Each of the passageways have smaller cross sectional flow areas than the nozzle to filter the ink, while the total cross sectional flow area of the passageways is larger than the total cross sectional flow areas of the nozzle. Many printheads can be made simultaneously by producing a plurality of sets of heating element arrays with their addressing electrodes on a silicon wafer and by placing alignment marks thereon at predetermined locations. A corresponding plurality of sets of channels and associated manifold with internal filters are produced in a second silicon wafer and in one embodiment alignment openings are etched thereon at predetermined locations. The two wafers are aligned via the alignment openings and alignment marks and then bonded together and diced into many separate printheads.

U.S. Pat. No. 4,251,824 to Hara et al. discloses a thermal ink jet printhead having a filter at the ink supply inlet to the printhead. U.S. Pat. No. 4,380,770 to Maruyama discloses an ink jet printhead having an embodiment shown in FIG. 6 that uses a linear array of grooves to filter the ink. The above references disclose the assembly of individual filters for each printhead or the incorporation of integral filters which require more complicated photolithographically patterned printhead parts.

U.S. Pat. No. 4,673,955 to Ameyama et al. discloses an ink reservoir for a drop-on-demand ink jet printer. The reservoir contains a relatively large ink supply chamber and a smaller ink chamber. Ink from the smaller chamber is in communication with the ink jet printhead. The larger ink supply chamber is hermetically sealed and in communication with the smaller chamber through a filter.

U.S. Pat. No. 4,864,329 to Kneezel et al. discloses an ink jet printhead formed from a pair of silicon wafers, one being a channel wafer having elongated ink channels communicating with an ink manifold on one surface and having fluid passageways communicating with ink inlets on the other surface. The surface having the ink inlets is covered with a dry pressure-transferred adhesive layer and then is laminated to a flat filter, such as of woven stainless steel mesh, to exclude any ink contaminants from entering the ink inlets, passageways, manifolds and channels where they can block the ink jet nozzles.

SUMMARY OF THE INVENTION

The present invention relates to a novel process for the formation of an ink filter layer at the ink inlet of a channel wafer to be used in the production of an ink jet printhead. The present process enables the application of an ink filter layer over the ink inlet openings of the channel wafer, without obstructing either the ink inlet openings or the ink passageways connected thereto. The present process also enables the use of spin-coating to produce the filter-forming resist layer, while preventing the normal edge bead from transferring to the channel wafer.

According to one embodiment of the present invention, the ink filter layer is formed by applying a filter-forming photoresist layer on an intermediate release surface, preferably a transparent flexible plastic film, such as by spin-coating; drying said layer to a semi-solid non-sticky adhesive condition; and transferring a planar portion of said dry layer to the surface of a channel wafer under the application of heat and pressure, either before or after the photoexposure and development of the filter layer.

The photoresist layer preferably is spin-coated onto a 1 to 2 mil thick clear Mylar film disk, such as one having a diameter which is greater than that of the channel wafer, and then soft baked to a dry adhesive condition. The photoresist layer can be photoexposed through a filter mask, directly or through the Mylar release support, or first can be transferred to the ink inlet surface of a channel wafer and then be photoexposed, developed and cured as an ink-filter layer which will prevent the passage of solid ink contaminants into the ink channels which communicate with the ink-ejecting nozzles of the printhead.

The present heat-and-pressure transfer process enables the transfer of dry, planar portions of a spin-coated photoresist layer, exclusive of the peripheral bead, to the ink-inlet surface of a silicon channel wafer provided that the diameter or area of the surface of the wafer is smaller than that of the resist coating present of the release film and does not engage the peripheral bead when the surfaces are pressed together while heating to cause the resist layer to become laminated to the wafer and to transfer thereto from the release film surface as it is peeled away.

The resist layer transfers as a dry, non-flowable layer over the discontinuous ink-inlet surface of the channel wafer, without any flow or penetration down into the ink channels. The soft-baked resist layer is photoexposed through a filter-forming mask and developed with filter openings, either before or after transfer from the release support. Finally, heat and pressure are applied to cure the filter layer.

The present invention provides an ink filtering system for each of a plurality of ink jet printheads by laminating a substantially flat wafer size filter to the ink inlet substrate or wafer containing a plurality of ink channel plates. Lamination of filter to the channel wafer may be done before or after assembly with the equal size substrate containing the plurality of sets of heating elements and their addressing electrodes as taught by the above-referenced U.S. Pat. No. 4,639,748. Individual printheads are typically formed by dicing the wafer-filter assembly.

This invention uses a semi-solid filter layer which minimizes dicing blade wear, minimizes thickness, optionally eliminates an adhesive layer and enables convenient sealing, for example, to ink supply cartridges of the type disclosed in U.S. Pat. No. 4,571,599 to Rezanka.

In the present process a plurality of ink jet printheads with laminated filters are fabricated from two (100) silicon wafers, the printheads being representative of a typical relatively small fluid handling device. A plurality of sets of heating elements and their individually addressing electrodes are formed on the surface of one of the wafers, and a corresponding plurality of sets of parallel channels, each channel set communicating with a recessed manifold are formed in a surface of the other wafer. A fill hole for each manifold and means for the alignment are formed in the other surface of the wafer with the channels. Alignment marks are formed at pre-determined locations on the wafer surface having the heating elements. A wafer-sized flat membrane filter is laminated on the wafer surface having the fill holes. The wafer surface with the channels are aligned with the heating elements via the alignment means and alignment marks and bonded together. The filter may be laminated on the wafer surface having the fill holes before or after this wafer is bonded to the wafer having the heating elements. A plurality of individual printheads are obtained by concurrently dicing the two bonded wafers and the laminated filter. Each printhead is sealingly bonded to an ink supply cartridge while the other side of the printhead is mounted on a daughter board as taught by U.S. Pat. No. 4,639,748 to Drake et al.

In such an ink jet printhead as described above, the nozzles have very small flow areas. This necessitates the use of fine filtration systems to prevent contaminating particles from clogging the printhead nozzles. For maximum effectiveness, ink filtration should occur at the printhead interface with the ink supply in order to filter as close to the nozzles as possible and yet not restrict the ink flow. For advantages in manufacturability, the wafer-sized flat filter should have a construction that minimizes dicing blade wear.

In addition to filtering contamination from the ink and ink supply system during printing, the laminated filter also keeps dirt and other contamination from entering the large ink inlets during printhead assembly.

THE DRAWINGS

Figure 2:
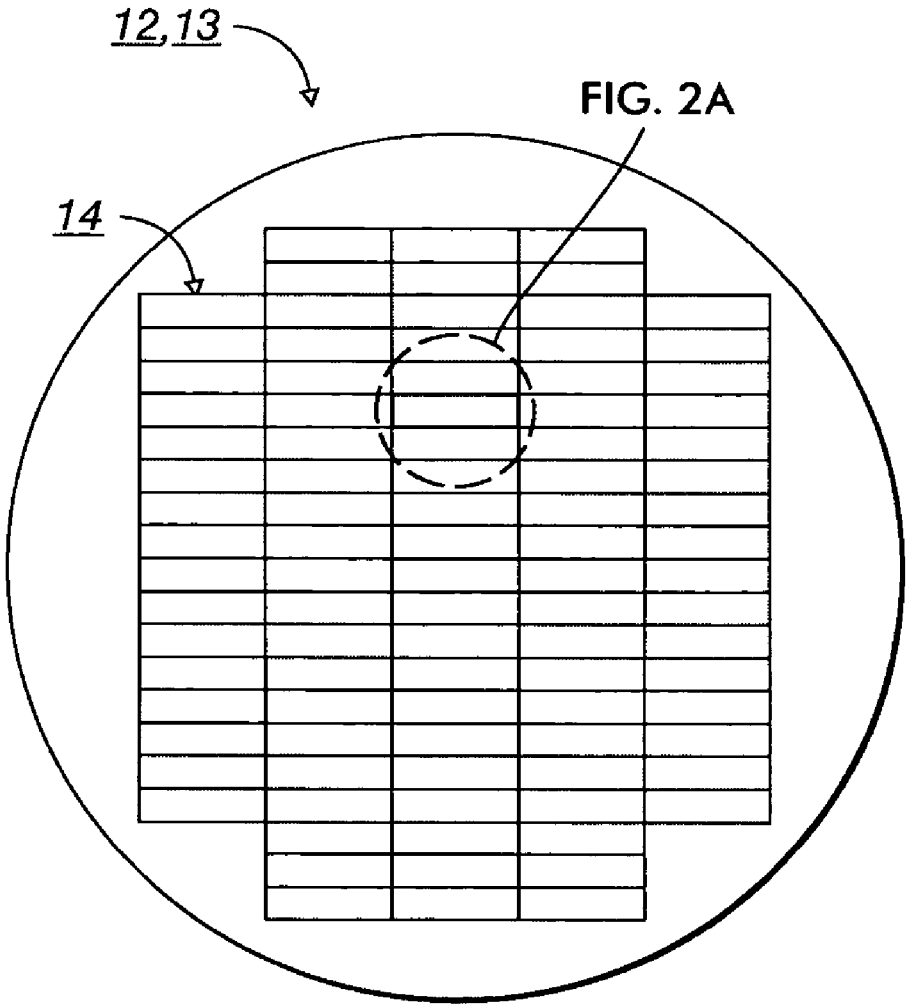
Figure 2A:
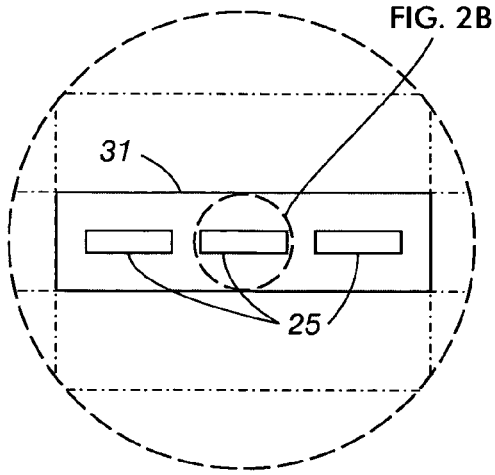
Figure 2B:
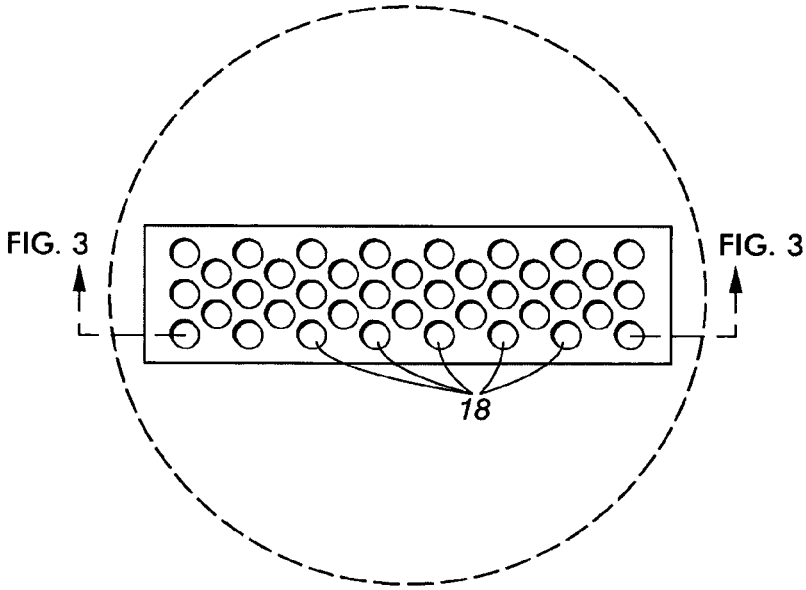
Figure 3:
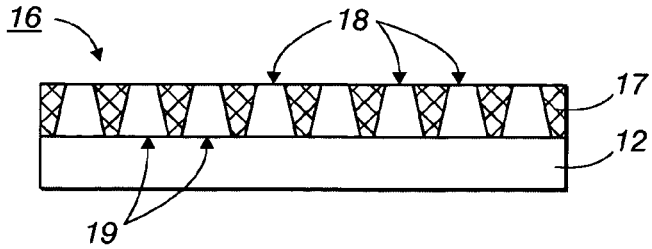

In the accompanying drawings,

FIG. 1 is a cross-sectional view, to an enlarged scale, illustrating the lamination and transfer of a uniform thickness of a soft-baked, semi-solid photopatternable, curable resist layer from an intermediate release film to the ink inlet surface of a patterned channel wafer;

FIG. 2 is a top view of a laminate 13 of photoexposed, processed resist filter layer 14 as in FIG. 1 forming an ink filter layer 14 over the ink inlets 25 on the surface of a channel wafer 12, the elements being shown in spaced relation for purposes of illustration;

FIG. 3 is a cross-sectional view of a segment of the laminate 13 of FIG. 2, illustrating the example of tapered cross-sectional area of the ink filter passages in association with the ink inlet openings of the channel wafer.

DETAILED DESCRIPTION

Referring to FIG. 1, a flexible, translucent release substrate, such as a 1-2 mil Mylar film disk 10 is spin coated on one surface with a photoresist layer 11 such as a photopatternable epoxy novolak polymer composition and soft baked to a dry semi-solid adhesive condition.

Next, a patterned silicon channel wafer disk 12, having a smaller diameter than the resist-coated Mylar disk 10, is centered and laminated to the dry resist layer 11 under heat and pressure. After cooling the Mylar disk is peeled away, transferring a level portion 14 of the semi-solid resist layer to the ink inlet surface of the silicon wafer 12 while retaining peripheral bead portions 11*a* of layer 11 on the Mylar disk, which portions are beyond the area against which the wafer surface was pressed. Thus, the undesirable edge bead 11*a* is left on the Mylar substrate leaving a topographically perfect and level photoresist layer 14 on the silicon channel wafer substrate 12 as laminate 13. Since the resist layer 14 is transferred to the channel wafer 12 as a dry semi-solid layer it does not flow into or contaminate the ink-inlet wafer cavities 25 which allow the flow of ink from the delivery cartridge to the heater plate, ink channels and nozzles during use of the ink jet printhead.

In the next step, the photoresist layer is photoexposed and developed to convert it to an ink filter layer 14, using a mask to form a desired plurality of clean, defect-free passages 18 which may be somewhat cylindrical, conical or semi-parabolic in cross-sectional shape (depending on exposure and development conditions) and have a narrower ink-inlet opening 18 at the surface of the layer 14, tapering out to a wider opening 19 at the surface of the channel wafer 12, to form an integral filter/channel wafer or plate 13 having exit openings 19 which are larger in diameter and provide increased ink flow into the ink manifold. The small inlet openings 18 filter out or exclude solid ink contaminants from the wafer openings 25 and interior passages or channels, and the larger exit openings 19 permit free ink flow into the wafer openings 25 and ink manifold which is in communication therewith.

Optionally, the photoexposure and development of the photoresist layer may be done while the layer is still on the Mylar disk before it is transferred to the silicon wafer.

The drawings, particularly FIG. 2 thereof, illustrate the simultaneous production of a large number of filtered ink jet printheads simultaneously from a single channel wafer-heater wafer laminate.

In FIG. 1, a two side polished, (100) silicon wafer 12 is used to produce a plurality of upper substrates or channel plates 31 for a corresponding plurality of printheads. After the wafer is chemically cleaned, a pyrolytic CVD silicon nitride layer (not shown) is deposited on both sides. Using conventional photolithography, vias for fill holes 25 for each of the plurality of channel plates 31 and at least two vias for alignment openings or pits (not shown) at predetermined locations are printed on the wafer side shown in this figure. The silicon nitride is plasma etched off of the patterned vias representing the fill holes and alignment openings. As disclosed in the above-mentioned U.S. Pat. Nos. 4,639,748 or Re. 32,572 to Hawkins et al. a potassium hydroxide (KOH) anisotrophic etch is used to etch fill holes and alignment openings. In this case, the {111} planes of the (100) wafer make an angle of 54.7° with the surface of the wafer. The fill holes 25 shown in FIG. 2, are much larger than the nozzle openings of the ink jet printhead. Typical fill hole dimensions are on the order of 1 mm, which may be 20 to 100 times larger than typical nozzle dimensions—hence the desirability of a filter over the ink inlet to prevent particles from entering and clogging the nozzles.

The essential novelty of the present invention resides in the preparation of a semi-solid photoresist layer 14 by spin-coating means, and transfer thereof to the discontinuous ink-inlet surface of a patterned channel wafer without any blockage of the ink-inlet openings thereof, followed by curing to form the ink compatible filter layer 14. Layer 14 may be photoexposed through a filter mask and developed with openings 18/19 either before or after transfer to the patterned ink inlet surface of the channel wafer 12. Note: although layer 14 has been referred to, for simplicity, as a single layer, structures may also be built up using a multilayer process.

Since the filter layer 14 consists of a thin polymer layer it enables the plurality of channel plate segments 31 with laminated filter layer 14 to be diced away with minimum blade wear. For even less dicing blade wear, the polymer layer may be patterned out of the dicing streets at the same time as the patterning of the filter pores.

While the photoresist composition for forming the filter layer 14 may be any conventional curable polymer composition, which is chemically compatible with the fluid to be filtered, such as polyimide or polyarylene either or others disclosed in the prior art referred to herein, embodiments described below will use the example of a highly functionalized glycidylepoxy-derivatized bis phenol-A novolak resin compounded with a photoacid-generating catalyst to form an ideal negative resist for fabrication of fluidic pathways in the present ink nozzle layers. This material can be spin cast onto a release surface such as a Mylar film 10 as in FIG. 1, and pre-baked in an oven to remove solvent and form a dry, semi-solid, adhesive resist layer 11.

The preferred photoresist solution is made by addition of about 63 parts by weight of an epoxy polymer of the formula

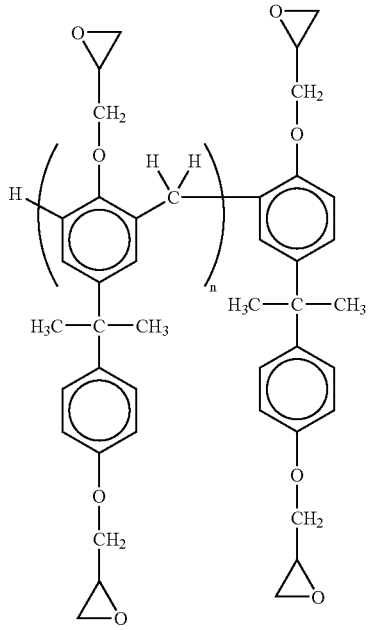

wherein n has an average value of 3 to about 20 parts by weight of γ-butyrolactone containing about 13 or 14 parts by weight triphenylsulfonium hexafluoroantimonate solution (supplied commercially as CYRACURE® UVI-6976 (obtained from Union Carbide) in a solution of 50 weight percent mixed triarylsulfonium hexafluoroantimonate in propylene carbonate). The resist-coated Mylar film is heated (soft baked) in an oven for between 15 and 25 minutes at 70° C. After cooling to 25° C. over 5 minutes, the soft baked resist layer 11 formed on the Mylar support film 10 was placed in surface contact with the patterned, ink-inlet surface of a channel wafer 12, and heat and pressure are applied to laminate the photoresist layer 11 to the surface of the channel wafer 12. Next, the Mylar support 10 is easily peeled away from the laminate to provide the resist-coated wafer 13. Then the level resist coating 14 on the wafer 12 is covered with a filter-forming negative mask and exposed to the full arc of a super-high pressure mercury bulb, amounting to from about 25 to about 500 milliJoules per square centimeter as measured at 365 nanometers. The exposed wafer is then heated at from about 70 to about 95° C. for from about 10 to about 20 minutes post-exposure bake, followed by cooling to 25° C. over 5 minutes. The uncured areas of the resist coating are developed with γ-butyrolactone, washed with isopropanol, and then dried at about 70° C. for about 2 minutes to form the filter-coated wafer 13 shown in FIG. 2 having a filter layer 14, shown in FIG. 3, containing tapered, narrow filter inlets 18 which exclude the entry of ink contaminants to the ink inlets 25 of the channel wafer 12.

The present filter layer 14 is formed by crosslinking the precursor polymer which is a phenolic novolac resin having glycidyl ether functional groups on the monomer repeat units thereof.

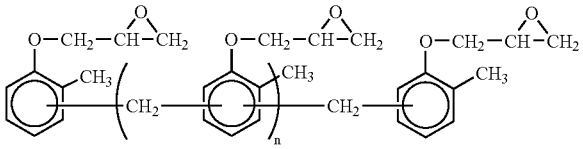

Preferred polymers are commercially available from, for example, Shell Resins, Resolution Performance Products, Houston, Tex. as EPON® SU-8 and DPS-164. Suitable photoresists of the general formulae set forth hereinabove are also available from, for example, Dow Chemical Co., Midland, Mich.

The filter layer 14 containing the crosslinked epoxy polymer is prepared by applying to the intermediate release film 10 or glass support a photoresist layer 11 containing the uncrosslinked precursor epoxy polymer, an optional solvent for the precursor polymer, a cationic photoinitiator, and an optional sensitizer. The solvent and precursor polymer typically are present in relative amounts of from 0 to about 99 percent by weight solvent and from about 1 to 100 percent precursor polymer, preferably are present in relative amounts of from about 5 to about 60 percent by weight solvent and from about 40 to about 95 percent by weight polymer, and more preferably are present in relative amounts of from about 5 to about 40 percent by weight solvent and from about 60 to about 95 percent by weight polymer, although the relative amounts can be outside these ranges. Examples of suitable solvents include γ-butyrolactone, propylene glycol methyl ether acetate, tetrahydrofuran, methyl ethyl ketone, methyl isobutyl ketone, mixtures thereof, and the like.

Sensitizers absorb light energy and facilitate the transfer of energy to another compound, which can then form radical or ionic initiators to react to crosslink the precursor polymer. Sensitizers frequently expand the useful energy wavelength range for photoexposure, and typically are aromatic light absorbing chromophores. Sensitizers can also lead to the formation of photoinitiators, which can be free radical or ionic. When present, the optional sensitizer and the precursor polymer typically are present in relative amounts of from about 0.1 to about 20 percent by weight sensitizer and from about 80 to about 99.9 percent by weight precursor polymer, and preferably are present in relative amounts of from about 1 to about 20 percent by weight sensitizer and from about 80 to about 99 percent by weight precursor polymer, although the relative amounts can be outside these ranges.

Photoinitiators generally generate ions or free radicals which initiate polymerization upon exposure to actinic radiation. When present, the optional photoinitiator and the precursor polymer typically are present in relative amounts of from about 0.1 to about 20 percent by weight photoinitiator (in its pure form; not accounting for any solvent in which it may be commercially supplied) and from about 80 to about 99.9 percent by weight precursor polymer, and preferably are present in relative amounts of from about 1 to about 20 percent by weight photoinitiator and from about 80 to about 99 percent by weight precursor polymer, although the relative amounts can be outside these ranges.

A single material can also function as both a sensitizer and a photoinitiator.

While the printheads of the present invention can be prepared with photoresist solutions containing only the precursor polymer, cationic initiator, and optional solvent, other optional ingredients can also be contained in the photoresist. For example, diluents can be employed if desired. Examples of suitable diluents include epoxy-substituted polyarylene ethers, such as those disclosed in U.S. Pat. No. 5,945,253, the disclosure of which is totally incorporated herein by reference, bisphenol-A epoxy materials, such as those disclosed as (nonpatternable) adhesives) in U.S. Pat. No. 5,762,812, the disclosure of which is totally incorporated herein by reference, having typical numbers of repeat monomer units of from about 1 to about 20, although the number of repeat monomer units can be outside of this range, and the like. Diluents can be present in the photoresist in any desired or effective amount, typically at least about 1 part by weight per 1 part by weight precursor polymer, and typically no more than about 70 parts by weight per one part by weight precursor polymer, preferably no more than about 10 parts by weight per one part by weight precursor polymer, and more preferably no more than about 5 parts by weight per one part by weight precursor polymer, although the relative amounts can be outside of these ranges. Other optional variants include the use of a mixture of a cationic and radical resin in order to optimize material properties.

The filter layers 14 of the present invention can be prepared with high aspect ratios and straight sidewalls. Conical filter passages with inlets 18 as small as 5 microns wide can be easily resolved in 28 micron thick films exposed at, for example 200 to 500 milliJoules per square centimeter (typically plus or minus about 50 milliJoules per square centimeter, preferably plus or minus about 25 milliJoules per square centimeter) (aspect ratio of 5.6). Preferred exposures can vary depending on the cationic initiator employed, the presence or absence of a diluent, relative humidity, and the like. These results easily enable high filter pore densities. Scanning electron microscopy micrographs indicate a topographically level surface devoid of detrimental lips or dips.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Resist Solution Preparation

A resist solution was prepared by jar 33 grams of γ-butyrolactone (obtained from Aldrich Chemical Co., Milwaukee. Wis.) and 23.3 CYRACURE® UVI-6976(containing 50 percent by weight triphenysulfonium hexafluoroantimonate in propylene carbonate, obtained from Union Carbide). Thereafter, 115 grams of EPON® SU-8 epoxy polymer of the formula

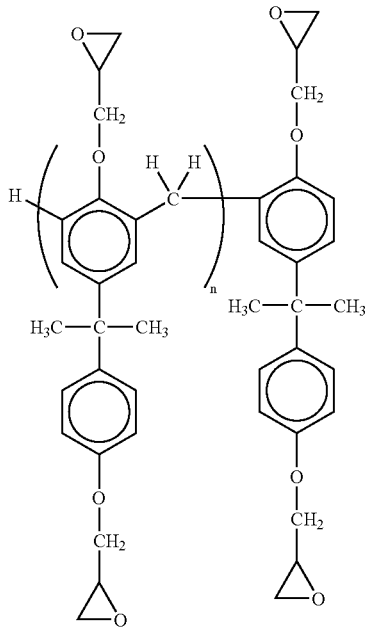

wherein n has an average value of 3 (obtained from Shell Resins) was added to the jar and the solution was mixed on a STONEWARE® roller for about one week prior to use.

A commercial resist solution of EPON SU-8 was also obtained from MicroChem Corporation Newton, Mass., and was used as received. This commercial solution is of similar composition to the one prepared as described, more specifically, accordingly to the MSDS sheet for this product, the commercial solution contained between 25 and 50 percent by weight γ-butyrolactone, between 1 and 5 percent by weight of a mixed triarylsulfonium hexafluoroantimonate salt (sulfonium) thiodi-4,1-phenylene)bis(diphenylbis((OC-6-11)hexafluoroanti monate(1-)), CAS 89452-37-9, and p-thiophenoxyphenyldlphenysulfonium hexafluoroantimonate, CAS 71449-78-0) in propylene carbonate, and between 50 and 75 percent by weight of the epoxy resin.

Transfer Substrate Preparation

A thin transparent film or glass support, preferably a 1-2 mil film of Mylar (polyethylene terephthalate), has applied thereto 3 to 4 grams of the resist solution followed by spin coating on a Headway Research Inc. PWM 101 spin coater at 2000 to 4000 rpm for 20 seconds. The resulting film coating was soft baked in a circulating air oven at 70° for 20 minutes.

Laminate Preparation

Silicon channel wafers, the top levels of which contained oxide or bare silicon were cleaned in a bath containing 75 percent by weight sulfuric acid and 25 percent by weight hydrogen peroxide at a temperature of 120° C. Heater wafers were treated with an oxygen plasma prior to use. The wafers were heated on a hot plate at 70° C. for 2 minutes prior to lamination to the soft baked photoresist layer on the Mylar transfer substrate. Two methods were employed to increase contact between the dry resist layer on the Mylar disc and the silicon substrate. The first includes stacking 10 blank silicon wafers on top of the Mylar composite while in the oven. The second method includes rolling a steel mandrel back and forth over the Mylar surface before the composite has an opportunity to cool. The Mylar release layer can be removed easily after the composite has equilibrated to room temperature. Both released films and unreleased films were then photo-exposed and processed according to normal procedures where both types of films yielded clean defect free filtration structures (FIGS. 2 and 3). The cylindrical conical ink passages 18/19 are approximately 10-30 μm in width and are dependent upon the mask, film thickness, and processing conditions. It was also possible to photo-expose the resist using Mylar as the substrate and in this manner clean defect free filtration features were also achieved. With appropriate release materials the resist can be separated free from the Mylar substrate yielding a freestanding plastic ink filtration sheet.

Photoexposure and Processing

The wafers 12 containing the soft-baked resist films 14 laminated thereon were exposed through a chromium mask to the actinic radiation of an exposure aligner unit until the required dose had been delivered to the film. Exposure was effected with two different tools: (a) a CANON®PLA-501FA unit with a 250 Watt Ushio super-high pressure mercury lamp (model 250D) as the light source; (b) a KARL SUSS®MA 150 unit with a 350 Watt Ushio super high pressure mercury lamp (model 350DS) as the light source. The light intensity was about 6 to 10 milliwatts per square centimeter for each unit measured at 365 nonometers. Both exposure stations were operated on contact printing mode and the light intensity was measured at 365 nonometers. Light intensity for exposure with the CANON®PLA-501FA unit was performed using a UVP model UVX digital radiometer: the KARL SUSS® MA 150 unit had a built-in internal radiometer. All wafers were subjected to a post-exposure bake for 15 to 20 minutes at 70 to 95° C. in a circulating air oven directly after exposure. Subsequent to the post-exposure bake, the latent images were exposed to development with γ-butyrolactone (obtained from Aldrich Chemical Co.), followed by rinsing with isopropanol.

Results

Overall, clean, well-resolved filter layers with passages of parabolic or conical cross-section, with diameters between about 10 and 30 microns and film thicknesses of about 30 microns were formed on a channel wafer. Nearly identical results were obtained with the resist solution mixed as indicated above and the commercial resist solution obtained from MicroChem Corporation.

Other embodiments and modifications of the present invention may occur to those of ordinary skill in the art subsequent to a review of the information presented herein; these embodiments and modifications, as well as equivalents thereof, are also included within the scope of this invention.

What is claimed is:

1. Process for forming a fluid inlet wafer for a microfluidic device, said wafer having a fluid particle-filter layer over the discontinuous fluid-inlet surface thereof comprising the steps of applying a thin coating of a heat-curable, photopatternable polymer composition to an intermediate substrate having a release surface; drying said coating to form a semi-solid adhesive layer; pressing said layer and supporting substrate against the discontinuous fluid-inlet surface of a fluid inlet wafer and optionally an additional adhesive layer to bond said layer to said discontinuous fluid inlet surface; separating said substrate to transfer the contacting area of said semi-solid layer to said discontinuous fluid-inlet surface as a laminate without any penetration into the fluid inlet passages thereof, photoexposing said semi-solid layer, through a filter-forming mask and developing fluid particle-filter openings therethrough, either before or after transfer of said semi-solid adhesive layer from said intermediate substrate to said discontinuous fluid-inlet surface of said fluid inlet wafer, and heat curing said filter layer so that the filter layer is a monolithic layer in contact with the discontinuous fluid-inlet surface of the wafer.

2. A process according to claim 1 wherein the microfluidic device is an ink jet printhead.

3. A process according to claim 1 wherein the fluid inlet wafer is a channel wafer.

4. A process according to claim 1 wherein the photopatternable polymer is patterned out of the dicing streets at the same time the filter pores are patterned.

* * * * *